United States Patent [19]

Martell

[11] Patent Number: 4,949,067

[45] Date of Patent: Aug. 14, 1990

[54] WARNING SYSTEM FOR RACETRACK

[76] Inventor: Richard J. Martell, 4929 Orangeport Rd., Brewerton, N.Y. 13029

[21] Appl. No.: 325,109

[22] Filed: Mar. 17, 1989

Related U.S. Application Data

[63] Continuation-in-part of Ser. No. 944,658, Dec. 22, 1986, abandoned.

[51] Int. Cl.[5] ..... G08B 23/00

[52] U.S. Cl. ..... 340/323 R; 340/902; 340/905; 340/908

[58] Field of Search ..... 340/323 R, 901, 905, 340/908; 455/54, 57, 95, 97, 89, 90

[56] References Cited

U.S. PATENT DOCUMENTS

| | | | |
|---|---|---|---|
| 2,442,851 | 6/1948 | Halstead | 340/905 |
| 3,233,217 | 2/1966 | Bost | 340/901 |
| 3,772,641 | 11/1973 | Grosser et al. . | |
| 3,824,469 | 7/1974 | Ristenbatt | 340/905 |
| 4,100,529 | 7/1978 | Evans | 340/901 |
| 4,196,412 | 4/1980 | Sluis et al. | 340/576 |
| 4,438,429 | 3/1984 | Park | 340/901 |

*Primary Examiner*—Donnie L. Crosland
*Attorney, Agent, or Firm*—Wall and Roehrig

[57] ABSTRACT

A race hazard condition alerting system includes a transmitter actuated by a flagman or other race official and a sufficient number of receiver units so that each race car will have a receiver unit. The transmitter transmits a coded signal, which can be received everywhere along the race course, to correspond to a red, yellow, or green flag condition. The receiver units, which are each self-contained with a built-in power supply, receive and decode the signal and then switch on green, yellow, or red lamps. This system provides the race competitors with substantially instantaneous alerting to any hazard condition on the track. In a preferred embodiment, a flash capability is included. The transmitter can also operate a trackside warning light system.

9 Claims, 2 Drawing Sheets

WARNING SYSTEM FOR RACETRACK

This is a continuation-in-part of my copending U.S. patent application Ser. No. 944,658, filed Dec. 22, 1986, now abandoned.

BACKGROUND OF THE INVENTION

This invention relates to vehicle emergency warning systems, and is more particularly directed to a radio system which is used for communicating a yellow flag, i.e., caution condition, from a race official to the drivers of race cars or other racing vehicles and closed loop race course.

In automobile racing, when a caution period is declared by a race official, a flagman (or several flagmen) will indicate this to the drivers by displaying a yellow flag. This is often supplemented by trackside caution lamps. This existing system has a number of drawbacks, which result in collisions and pile-ups that occur "under the yellow flag".

The existing system of flags and lights relies on a race competitor's seeing the flag or light at a time when he or she is concentrating completely on operating the race car. Because of the nature of the driving competition, it is often difficult for the drivers either to see the existing system or to react to it. One of the main pitfalls of the existing system is that, due to dust and smoke on the course, proximity to or distance from the existing system, or glare of sunlight in the eyes of the drivers, as well as the need to concentrate on the driving, competition drivers cannot all be expected to see the caution signal at the same time. Also, because a driver and race car may often have to complete an entire loop before passing under the flagman, many competitors take advantage of the first lap of a caution period by overtaking another car and bettering their position in the race. This, of course, is highly dangerous as the race car driver will often steer into the very same wrecked car that is the reason a caution was declared.

Also, the two existing systems, flagmen and lights, are not always initiated at the exact same time, and some of the drivers will rely on one or the other, but not both. Moreover, one competitor's view may often be blocked by another competitor's race car. In either case, if a competitor reacts to the caution, a closely-following competitor may not see the caution at the same time and not react, which can eventuate in a rear end collision that is costly and extremely dangerous for both competitors. This type of collision can result in serious injury or death.

Because of accidents of this type that can occur while "under the yellow", race promotors have experienced sharply increased cost for insurance, and race fans experience considerable delays in the race due to extra "clean up".

In short, the existing caution alerting systems for motor vehicle racing lack the ability to signal a caution warning to all the competitors simultaneously, and cannot ensure that the competitors will be alerted to the caution under all race conditions.

OBJECTS AND SUMMARY OF THE INVENTION

It is an object of this invention to provide a race hazard condition alerting system which avoids the above-mentioned drawbacks of existing systems.

It is another object of this invention to provide a race hazard condition alerting system in which an alerting indicator is positioned in plain view of every competitor and will let every competitor know simultaneously when there is a caution period declared by the race official.

It is a still further object of this invention to provide such a system which has dual elements for a built-in back-up.

It is a general object of this invention to provide a race hazard condition alerting system which will eliminate the dangerous practice of "passing under the yellow".

It is yet a further object of this invention to provide a race hazard condition alerting system which alerts race vehicle drivers under all adverse conditions, i.e., when dust on a dirt course, or sunlight on dirt, asphalt, water, or air makes it impossible to see a flag or trackside light of existing systems.

It is still another object of this invention to provide a race hazard condition alerting system which is effective in both daytime and night competition.

According to an aspect of this invention, the race hazard condition alerting system is well adapted for use on a closed loop race course around which a number of race cars or other racing motor vehicles proceed. A race course official monitors track conditions and communicates to the competitors when he declares a hazard condition, during which the race car drivers are to observe caution rules (i.e., "hold position", "no passing").

The system has a transmitter which is actuated by the race official and a number of receiver units each of which is disposed in a respective one of the race cars in plain view of the driver.

The transmitter transmits an RF carrier, typically about 50 MHz, which is modulated to indicate the presence (or absence) of the hazard condition. A manual switch on the transmitter permits the flagman to select the signal that is transmitted so as to correspond to the observed hazard condition (i.e., green, yellow or red), and this is radiated by means of an antenna or antenna system over a range that encompasses the entire race course.

Each of the receiver units have means for mounting it in the associated race vehicle, an antenna to receive the signal transmitted by the transmitter, a demodulator to demodulate the signal carrier to produce a hazard indication, and a hazard lamp which is actuated by the hazard indication. Preferably, there are two each of green, yellow, and red lamps which are lit to indicate green, yellow and red flag conditions, in response to the flagman actuating the manual switch to the corresponding position on the transmitters. When there is a change in hazard condition, i.e., if the flagman signals a caution (yellow flag) the yellow lights will light up the receiver units in all the race cars at the same time, and these are clearly visible to all the drivers under all road conditions.

The signals are coded at the transmitter side and decoded at the receiver unit side, so specific codes are used to light the caution lamps. This prevents stray or spurious signals or RF noise from accidentally misindicating a caution.

The transmitter can be connected with an electrical supply for the trackside caution light system so that the same switch that actuates the lights in the race car receiver unit also turns on the corresponding lights in the trackside system.

A flasher can be incorporated to cause the receiver unit lamps to flash at the option of the flagman or other race official.

The above and many other objects, features, and advantages of this invention will be more fully understood from the ensuing detailed description of a preferred embodiment, which is to be read in connection with the accompanying drawing.

DETAILED DESCRIPTION OF THE PREFERRED EMBODIMENT

Figure 1:
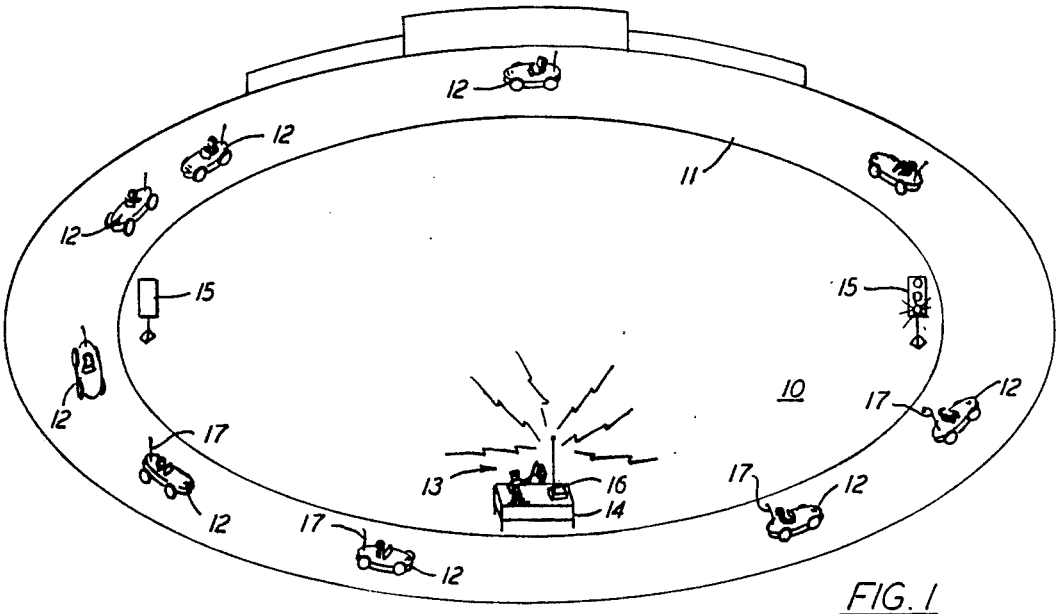
FIG. 1 is a perspective view showing a motor speedway race course at which the system of this invention is employed.

With reference to the drawing, and initially to FIG. 1, a race course 10 is shown to consist of a closed loop track 11 around which a number of race cars 12 proceed. A flagman 13 is positioned on a platform 14 near the track 11, preferably at the start/finish line. On many tracks additional flagmen, i.e., corner men, are stationed at various positions around the track. To start the race, the flagman 13 displays a green flag, and at the end displays a checkered flag to indicate a car has finished. The flagman 13 also displays a yellow flag when a caution period has been declared, for example, in the case of a disabled race car on the track or some other hazard that must be cleared. A red flag is used when the hazard is so severe that the race must be halted.

In order to augment the flag system, many race tracks also employ a trackside caution light system 15 which can have green, yellow and red lights that are lit respectively during normal race, caution, and severe or halt conditions.

As mentioned above, it is often difficult for the competitors to see the flagman 13 or the light system 15 owing to dust, glare, an obstructing race vehicle, or other reason. Because of this it often occurs that a competitor is not alerted to the caution in time to avoid a mishap that results in damage to the race vehicle, and could result in injury or death of the competitor.

In order to minimize the chances of this happening, the race course 10 has a radio type hazard alerting system configured according to the present invention, with a transmitter 16 that is actuated by the flagman 13 in the event a caution or other race condition is declared, and receiver units 17 carried in each and every one of the competing race cars 12 which indicate clearly to the drivers that a green, yellow, or red condition is in effect, and which do so for all the race cars 12 simultaneously.

Figure 3:
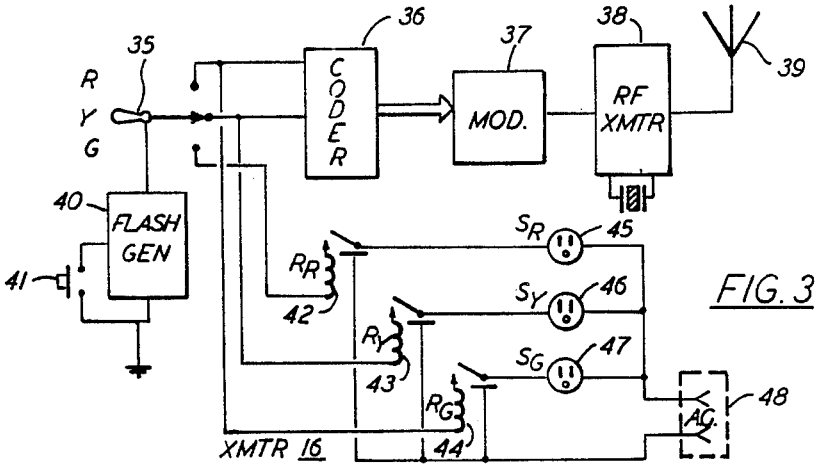
FIG. 3 is a schematic view of a transmitter according to an embodiment of this invention.
Figure 2:
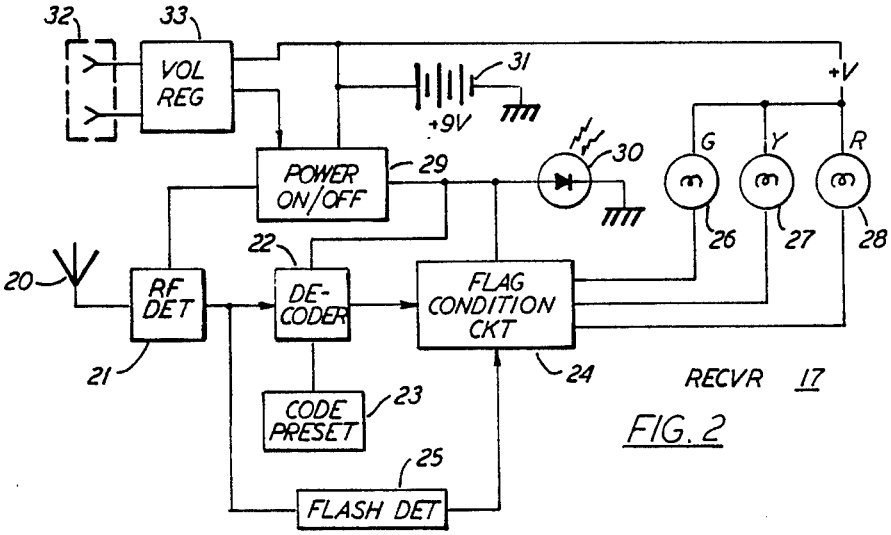
FIG. 2 is a schematic view of a receiver module according to an embodiment of this invention.

The receiver unit 17 has the basic circuitry as generally shown in FIG. 2, and the transmitter 16 is configured generally as shown in FIG. 3.

The electronics of the receiver unit 17 include an antenna 20 which picks up the modulated signal from the transmitter 16 and feeds the signal to an RF detector 21 which is followed by a pulse-code modulation decoder 22. A code pre-set selector 23 is employed to select respective codings to identify green flag, yellow flag, and red flag conditions. The decoder 22 supplies an appropriate signal to a flag condition circuit 24. A flash detector 25 is coupled between the detector 21 and the flag condition circuit 24. The flag condition circuit 24 switches on a green lamp 26, a yellow lamp 27, or a red lamp 28, as appropriate. A power supply voltage +V is furnished through a power on/off circuit 29 to the detector 21, decoder 22, and flag condition circuit 24, and this power on/off circuit 29 also feeds a power-on LED 30 which is visible when power is being actively supplied to the circuits of the receiver unit 17. The flash detector 25 causes the lamps 26, 27, and 28 to flash on and off in response to a command carried on the radio signal from the transmitter 16.

Power is supplied from a self-contained power supply, here a nine-volt battery 31, which feeds the power on/off circuit 29 and the lamps 26–28. The vehicle electrical system can optionally supply operating voltage through a connector 32 and voltage regulator 33 to the power on/off circuit 29 and to the lamps 26–28.

The transmitter 16 has a three-way selector switch 35 which the flagman can actuate to select green, yellow, or red flag conditions as appropriate. This switch 35 has three terminals connected respectively to inputs of a pulse-code modulation coder circuit 36 which supplies coded signals, corresponding to green, red, and yellow flag senses, through a modulator 37 and an RF transmitter 38 to an antenna 39. With this system, one of the three senses, i.e., red, yellow, or green, is transmitted. The RF transmitter circuit 38 has a predetermined frequency which corresponds to the frequency of all of the receiver units 17 in the system. In a preferred embodiment, this frequency is nominally about 50 MHz.

A flasher generator 40 produces a flash sense which is fed into the coder 36, and this flasher generator 40 is actuated by a flasher on/off switch 41.

The terminals of the switch 35 are also connected to respective red, yellow, and green condition relays 42, 43, and 44 which respectively connect AC outlets, 45, 46, and 47 with a source of AC power 48. These outlets 45, 46, and 47 are respectively connected to the red, yellow, and green lamps of the trackside lighting system 15.

Figure 4:
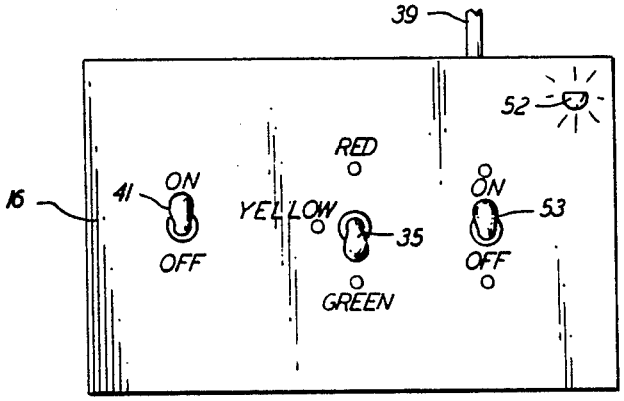
FIGS. 4 and 5 are front and rear views of a flagman's transmitter unit according to this invention.
Figure 5:
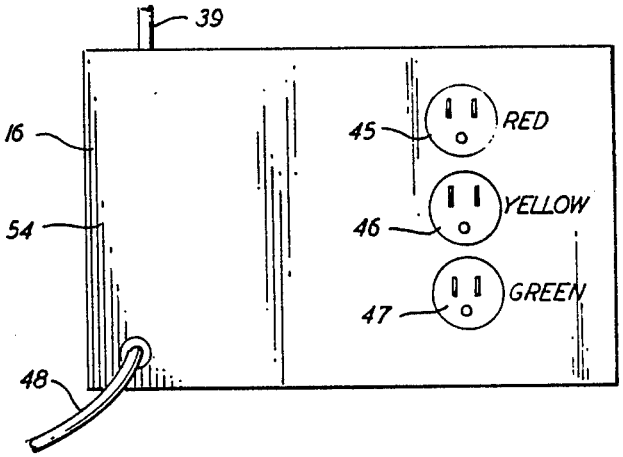

The transmitter 16 is contained within a case or housing 50 as shown generally in FIGS. 4 and 5. In the front panel 51 (FIG. 4) there are a power-on indicator pilot light, the flasher on/off switch 41, the light select switch 35, and a main power on/off switch 53. The antenna 39 is configured as a whip antenna which rises from the top of the housing 50. Optionally, the antenna can be remotely located at one or at several locations around the track 11.

On a rear panel 54 (FIG. 5) are the AC power input 48, and the AC outlets 45, 46, and 47 which feed the lamps of the trackside lighting system 15. The entire transmitter package is lightweight and rather compact, and can be disposed in near proximity to the flagman's station on the platform 14.

Figure 6:
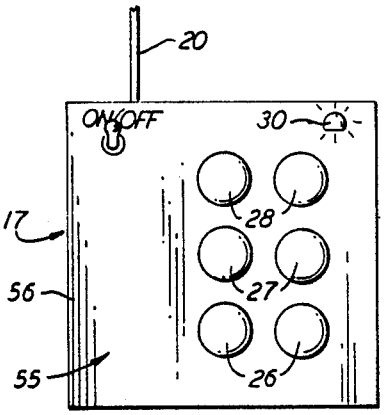
FIGS. 6 and 7 are front and rear views of a race driver's receiver unit according to this invention.
Figure 7:
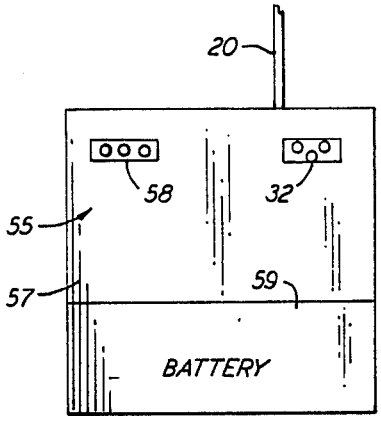

Each receiver unit 17 is disposed in a compact case or housing 55, as shown in FIGS. 6 and 7, and each receiver unit 17 is completely self-contained within the case or housing 55. On a front panel 56 (FIG. 6) are the on/off switch 29 and the system-on light 30. The red, yellow, and green lamps 26, 27, and 28 are redundantly provided; in this case there are two each of the lamps 26, 27, and 28. The antenna 20 is a short flexible whip antenna which rises from the top of the receiver unit housing 55.

On a rear panel 57 (FIG. 7) of the receiver unit housing 55 there are disposed an external lamp output connector 58, which is electrically connected to the flag condition circuit 24 in advance of the lamps 26, 27, and 28. The automotive power input connector 32 is also disposed on the rear panel 57.

At the lower part of the rear of the housing 55 is a cover 59 for a battery compartment which contains the nine-volt battery 31.

The receiver unit 17 is rather light in weight, weighing only one or two ounces, and is dimensioned to be only about three inches in height and width and about one inch in depth. The receiver unit 17 is held in place by a quick-mounting strap (which is not specifically shown), and the strap can be of Velcro or a similar pile type releasably attaching material. The entire receiver unit 17 is removably mountable on the dash of the race car 12 so that the lamps 26–28 are always in plain view of the driver.

Preferably, the transmitter 16 and all of the receiver units 17 are obtained by the track or course operator and are distributed by the operator to the competitors prior to race time so that this will insure that all of the receiver units 17 are on the same frequency and will not interfere with other radio devices in the area.

In other possible embodiments, the receiver unit 17 can omit the lamps 26 and 28, provide a yellow caution only, or the system can operate without the flasher capability. The exact configuration would depend on the needs and local operating conditions at the particular race course 10.

The system of this invention is not confined to automobile racing, but can be employed to advantage in racing of motorboats, airplanes, motorcycles or other racing motor vehicles.

While the invention has been described in detail with respect to a preferred embodiment, it should be recognized that many modifications and variations thereof would present themselves to those of skill in the art without departing from the scope and spirit of this invention, as defined in the appended claims.

What is claimed is:

1. A race condition alerting system for use on a closed loop race course to signal racing conditions to all of a plurality of racing motor vehicles proceeding around said closed loop race course, in which a race official monitors race course conditions and signals one of a plurality of conditions including a yellow flag or caution condition or a green flag or safe race condition, to be observed by the operators of said racing motor vehicles with one of said conditions being in effect at any time during a race, comprising:

transmitter means transmitting a carrier which is modulated with a racing condition signal to indicate a selected one of said conditions, including manually actuable means for permitting the race official to select between said conditions according to the observed race course condition, radiating means for radiating the carrier over a range that encompasses the entire race course, and a pulse-code-modulation encoder that encodes the modulated carrier for transmitting the selected one of the conditions; and a plurality of receiver units each including means for mounting in a respective one of each racing motor vehicles; antenna means to receive said carrier at all positions on said race course; a demodulator for demodulating said carrier; a decoder, corresponding to the encoder of said transmitter, to decode automatically said pulse-code-modulated carrier; indicating lights which comprise at least one yellow light and at least one green light; and means for switching on an associated one of said indicating lights in accordance with the decoded race course condition as represented by the decoded carrier and presenting a continuous positive visual indication to the respective operator at all times during the race; wherein the means for switching on an associated light includes a flag condition circuit coupled to an output of said decoder for switching over said green light and said yellow light only in response to the respective preset codes being applied to an input of said decoder, said flag condition circuit disregarding any codes except said preset codes;

such that when said race official actuates said manually actuable means to any of said conditions, all of the racing motor vehicle operators are presented with the same continuously visible condition indication at substantially the same time, and the associated one of the lights will be lit and visible to the race vehicle operators at all times during the race.

2. A race hazard condition alerting system as in claim 1 in which said transmitter means includes a code generator for coding said modulated carrier and said receiver units each include a corresponding decoder so that said visible hazard warning will not be actuated by noise, interference, or spuriously generated signals.

3. A race hazard condition alerting system as in claim 1, in which said transmitter means includes switched outlet means providing power to a race track hazard light system that has a plurality of lamps indicating respective hazard conditions, and means coupled to said manually actuable means and to said switched outlet means for effecting the illumination of the respective lamps of said race track hazard light system so as to correspond to the hazard condition being indicated by said modulated carrier.

4. A race hazard condition alerting system as in claim 3, in which there are three outlets in said switched outlet means providing power to green, yellow, and red lamps of said trackside hazard light system.

5. A race hazard condition alerting system as in claim 1, in which said transmitter means includes flasher generator means for selectively providing a flash signal to be modulated onto said carrier and manual switch means for selectively actuating said flasher generator means, and said receiver units each include means to cause said lights to flash on and off when said flasher generator means have been actuated on.

6. A race hazard condition alerting system as in claim 1, in which each said receiver unit includes a visible power-on light emitting device which provides a visible indication to the operator when power is being provided to said receiver unit.

7. A race hazard condition alerting system as in claim 1, in which said receiver units each include a receiver case, a self-contained battery power supply within said case, and a receive antenna affixed to said case.

8. A race hazard condition alerting system as in claim 7 in which said case includes quick-mount means for removably mounting said receiver unit on a dash of the respective race motor vehicle.

9. A race hazard condition alerting system as in claim 7 wherein said receiver unit further includes power input means for optionally connecting said receiver unit to a vehicle electrical supply.

* * * * *